US005752899A

United States Patent [19]

Ballard

[11] Patent Number: 5,752,899

[45] Date of Patent: May 19, 1998

[54] AQUATIC EXERCISE AND THERAPEUTIC SYSTEM

[76] Inventor: Thomas Ballard, 258 Manchester Rd., Highland Park, Mich. 48203

[21] Appl. No.: 832,474

[22] Filed: Apr. 2, 1997

Related U.S. Application Data

[60] Provisional application No. 60/014,654, Apr. 2, 1996 and provisional application No. 60/019,881, Jun. 18, 1996.

[51] Int. Cl. [6] ..... A63B 21/008; A63B 22/06

[52] U.S. Cl. ..... 482/111; 482/58

[58] Field of Search ..... 482/51, 52, 53, 482/54, 57, 58, 63, 62, 72, 73, 111, 112

[56] References Cited

U.S. PATENT DOCUMENTS

| | | | |
|---|---|---|---|
| 3,373,992 | 3/1968 | Ludeman | 272/73 |
| 3,559,634 | 2/1971 | Lillywhite | 128/66 |
| 3,913,907 | 10/1975 | Baker | 272/57 R |
| 4,162,788 | 7/1979 | Turnier | 272/71 |
| 4,188,030 | 2/1980 | Hooper | 272/73 |
| 4,249,725 | 2/1981 | Mattox | 272/117 |
| 4,712,788 | 12/1987 | Gaudreau, Jr. | 272/69 |
| 4,759,544 | 7/1988 | Diaz | 272/93 |
| 4,776,581 | 10/1988 | Shepherdson | 272/65 |
| 4,828,522 | 5/1989 | Santos | 441/129 |
| 4,938,469 | 7/1990 | Crandell | 272/69 |
| 4,971,317 | 11/1990 | Link | 272/73 |
| 5,050,863 | 9/1991 | Yacoboski | 272/71 |
| 5,123,641 | 6/1992 | Abboudi et al. | 482/54 |
| 5,135,448 | 8/1992 | Dunn et al. | 482/53 |
| 5,282,777 | 2/1994 | Myers | 482/122 |
| 5,316,532 | 5/1994 | Butler | 482/111 |
| 5,354,253 | 10/1994 | Awbrey et al. | 482/111 |
| 5,378,213 | 1/1995 | Quint | 482/54 |
| 5,385,525 | 1/1995 | Davis | 482/121 |
| 5,470,297 | 11/1995 | Park | 482/127 |
| 5,487,713 | 1/1996 | Butler | 482/111 |
| 5,514,057 | 5/1996 | Ciolino | 482/111 |
| 5,531,657 | 7/1996 | Macedo | 482/111 |
| 5,533,950 | 7/1996 | Lochbaum | 482/51 |
| 5,554,091 | 9/1996 | Patey | 482/111 |
| 5,558,604 | 9/1996 | Hopkins | 482/54 |
| 5,586,961 | 12/1996 | Quint | 482/111 |

*Primary Examiner*—Stephen R. Crow

*Attorney, Agent, or Firm*—Gifford, Krass, Groh, Sprinkle, Patmore, Anderson & Citkowski, P.C.

[57] ABSTRACT

The present invention is an aquatic exercise and therapeutic system comprising a plurality of aquatic exercise devices arranged about a central controller which permits adjustment of the water level and water temperature within each exercise device. Sensors which detect water level and temperature may be disposed in each exercise device to electrically communicate with the central controller. Individual controllers may also be provided on each exercise device so that the water level and temperature may be controlled by the user. The exercise devices are preferably arranged so that the longitudinal axis of each device extends radially outwardly from a center point where the water source, the central controller, and the means for heating the water are positioned. Each exercise device comprises a tank having an inner chamber. At the rearward end of the inner chamber, the wall is configured to form a seat suitable for positioning a user within the tank. An adjustable cycling assembly is positioned at the forward end of the inner chamber. A pair of oars is disposed in the inner chamber between the seat and cycling assembly. Partitions such as sliding curtains or moveable walls may be places around each exercise device to isolate the exercise devices and central area, thus permitting users to exercise in privacy.

11 Claims, 7 Drawing Sheets

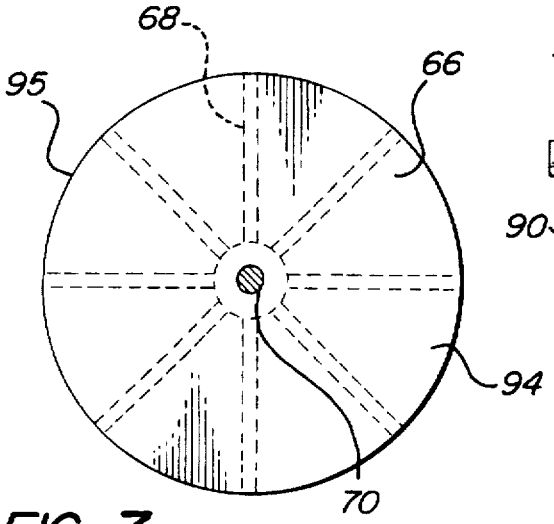
FIG-7
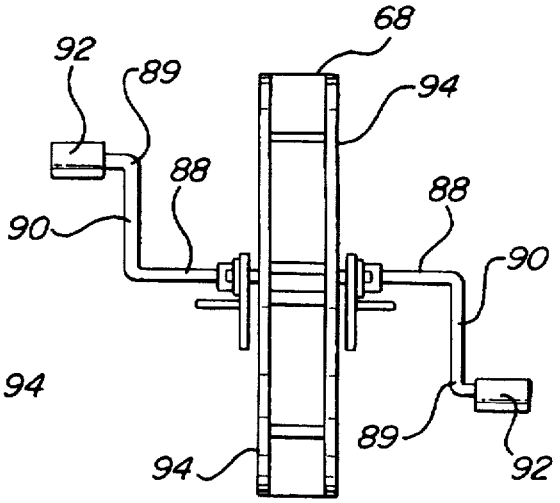
FIG-8
FIG-9
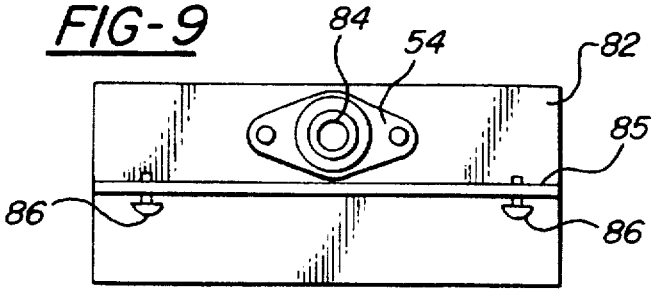
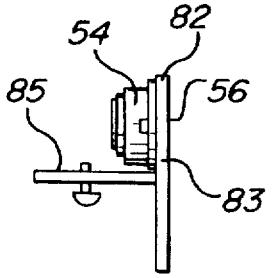
FIG-10
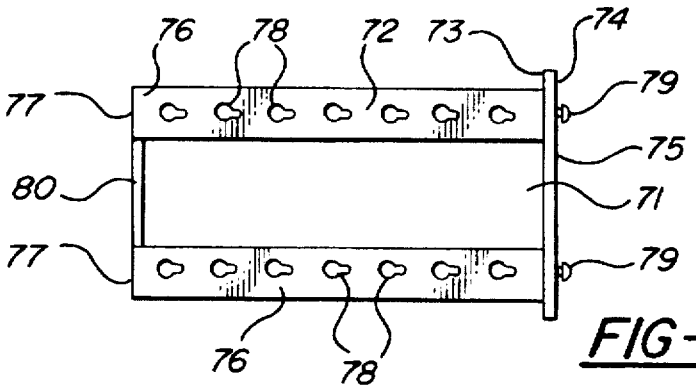
FIG-11
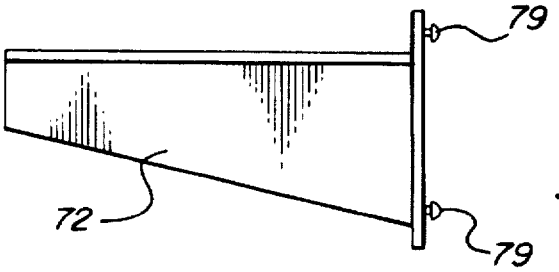
FIG-12

AQUATIC EXERCISE AND THERAPEUTIC SYSTEM

CROSS-REFERENCE TO RELATED APPLICATIONS

This application claims the benefit of United States Provisional application having Ser. No. 60/014,654 filed Apr. 2, 1996 and United States Provisional application having Ser. No. 60/019,881 filed Jun. 18, 1996.

FIELD OF THE INVENTION

The invention relates to an aquatic exercise and therapeutic system and, more particularly, to such a system including a plurality of aquatic exercise and therapeutic devices which may be controlled from a central location.

BACKGROUND OF THE INVENTION

A wide variety of aquatic exercise devices are available which enable a user to perform exercises under water. Many aquatic exercise devices enable a user to walk or run on a treadmill or perform cycling or skiing movements under water. Prior art aquatic exercise devices frequently utilize the resistance forces of water to increase the effectiveness of the exercises performed. Additionally, turbulence created by the user's movement through the water increases the therapeutic value of the exercises to the user.

Aquatic exercise devices frequently enable a user to exercise both upper body muscles as well as lower body muscles. For example, U.S. Pat. No. 5,586,961 to Quint discloses a universal aquatic exercise machine that includes a plurality of exercise devices, including a first exercise device which moves through a rotary path of motion which exercises the legs of the user and a second exercise device which includes oars which pivot from their lower end and move through a reciprocating motion which exercises the upper body of the user. U.S. Pat. No. 5,487,713 to Butler discloses an aquatic exercise and rehabilitation apparatus comprised of a fluid filled vessel and adjustable exercise cycle component having a unique pedal and handlebar assembly which are configured for use by individuals with diminished mobility or range of motion.

While the devices noted above and other aquatic exercise devices perform their functions satisfactorily, none of the exercise devices provide simple, adjustable exercise apparatus nor are they intended to function as part of a complete aquatic exercise and therapeutic system. In particular, the prior art does not disclose a comprehensive system which includes a plurality of exercise devices having centralized controls which enable a single operator to control variables in each device, such as water temperature and level within the device.

SUMMARY OF THE INVENTION

The present invention is an aquatic exercise and therapeutic system comprising a source of heated water and a plurality of aquatic exercise devices. A central controller for adjusting the water level and water temperature within each exercise device is in electrical communication the source of water and means for heating the water. Sensors which detect water level and temperature may be disposed in each exercise device. The sensors are in electrical communication with the central controller so that water level and temperature may be monitored remotely.

Individual controllers may also be provided on each exercise device so that the water level and temperature may be controlled by the user.

Each exercise device also comprises a water outlet and water inlet in fluid communication with the source of water. The controller is in communication with the outlet and inlet to control the flow of water into and out of each exercise device.

The exercise devices are preferably arranged so that the longitudinal axis of each device extends radially outwardly from a center point where the water source, the central controller, and the means for heating the water are positioned.

Each exercise device comprises a tank having a bottom surface and a vertical wall extending upwardly from the bottom surface to form an inner chamber. At the rearward end of the inner chamber, the wall is configured to form a seat suitable for positioning a user within the tank. Preferably, a safety mechanism such as a seat belt is attached to the seat to prevent the user from slipping forward into the water.

A cycling assembly is positioned at the forward end of the inner chamber. The cycling assembly comprises a turbine rotatably and adjustably mounted to a mounting bracket which extends substantially parallel to the bottom surface of the tank. A shaft having two ends and two offset portions positioned proximate to the ends of the shaft is mounted to the center of the turbine, the offset portions extending substantially perpendicular to the shaft. A pedal is mounted to each end of the shaft enabling a user to rotate the shaft and turbine by pushing on the pedals using a cycling motion. By adjusting the position of the turbine relative to the mounting bracket, the user may adjust the pedals in the horizontal direction. The mounting bracket is adjustably mounted to a frame attached to the vertical wall so that the user may adjust the position of the pedals in the vertical direction by moving the mounting bracket relative to the frame. Alternately, handgrips may be interchangeable used with the cycling assembly so that a user may grasp the handgrips and perform cycling motions with their upper arms.

A pair of oars is disposed in the inner chamber, each oar having an upper end, a lower end, and an inboard side. The upper end of each oar is pivotally and removably attached to the wall of the tank, permitting oars having varying configurations to be used in the exercise device. At least one rowing handle is positioned below the point where the oar is pivotally attached to the tank and extends from the inboard side of the oar. Rowing handles may be removably attached to the oars so that rowing handles having different configurations may be used interchangeably. A resistance element positioned proximate to the lower end of the oar extends from the inboard side of the oar to increase the resistance as the oar is moved through the water. Resistance elements may also be removably attached to the oars so that resistance elements of various sizes may be used interchangeably.

Preferably, an entry assist handle is attached to the inboard side of each oar and is aligned with the point at which the oar is pivotally attached to the wall.

A ladder, automatic lifting mechanism or other means for enabling the user to enter the tank is provided.

Partitions such as sliding curtains or moveable walls may be placed around each exercise device to isolate the exercise devices and central area, thus permitting users to exercise in privacy.

Other objects and advantages of the present invention will be apparent upon consideration of the following detailed description which refers to the following drawings:

BRIEF DESCRIPTION OF THE DRAWINGS

FIG. 7 is a side view of the cycling assembly depicted in FIG. 2;

FIG. 8 is a front view of the cycling assembly depicted in FIG. 2;

FIG. 9 is a front view of the turbine bearing assembly;

FIG. 10 is a side view of the turbine bearing assembly;

FIG. 11 is a top view of the turbine mounting bracket depicted in FIG. 1;

FIG. 12 is a side view of the turbine mounting bracket depicted in FIG. 11; and

DETAILED DESCRIPTION OF THE INVENTION

Figure 1:
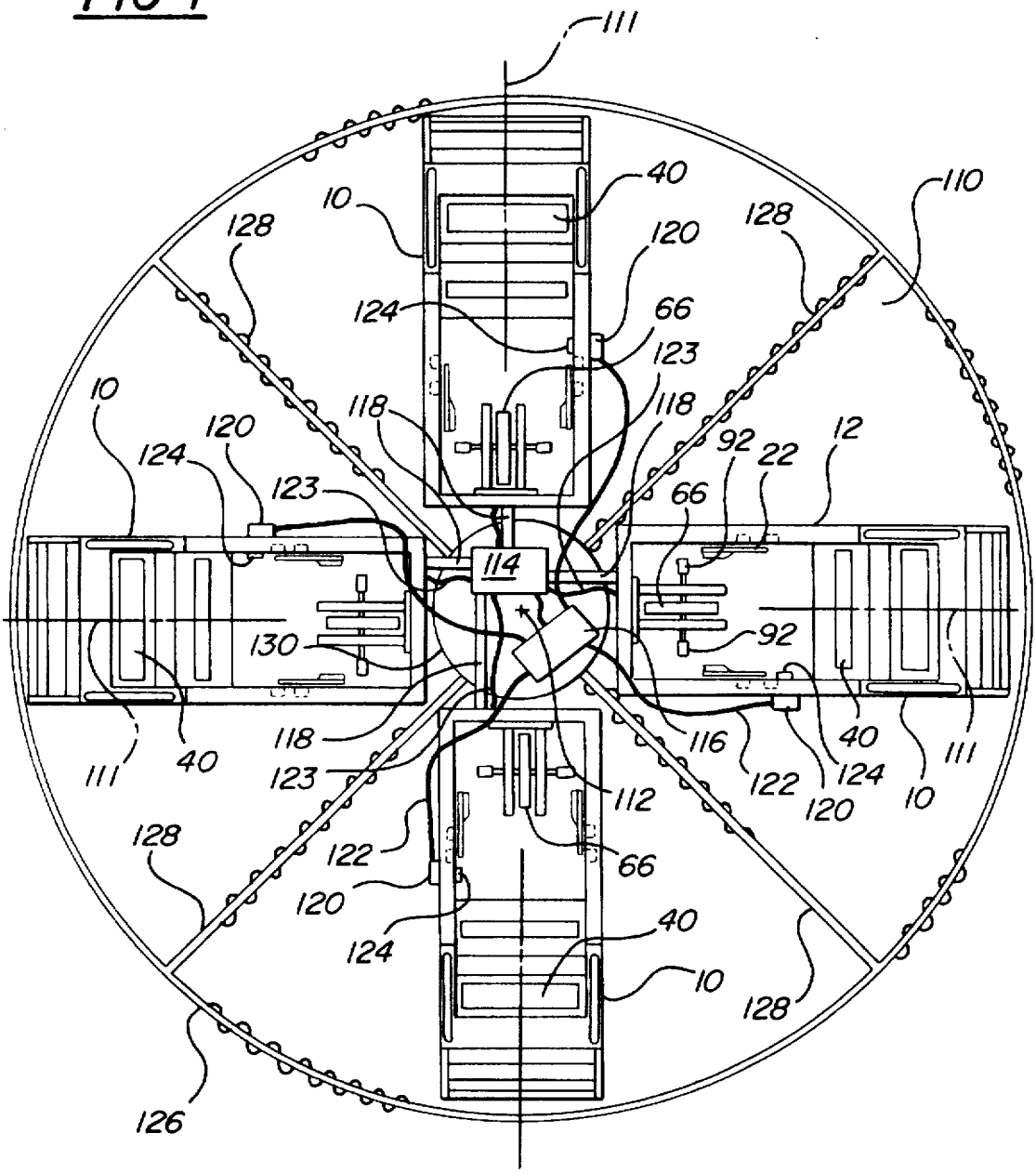
FIG. 1 is a top view of the aquatic exercise and therapeutic system of the present invention.

The present invention is an aquatic exercise and therapeutic system shown in FIG. 1 at 110. The system 110 comprises a plurality of aquatic exercise and therapeutic devices 10 shown in FIGS. 2–5, each device having a longitudinal axis 111. In the preferred embodiment, the devices are arranged about a central point 112 so that the longitudinal axis 111 of each device 10 extends radially outwardly from central point 112. Each aquatic exercise device 10, described more fully below, comprises a closed vertical wall 13 extending upwardly from a bottom surface 11 to form an inner chamber 14. Disposed within inner chamber 14 is a cycling assembly 87 and a pair of oars 22.

The system 110 comprises a centralized source of water 114 comprising a conventional heater suitable for heating water contained within the source of water 114. Inlet pipes 118 fluidly connect the water source 114 to a water inlet valve 102 in each device 10. Each water inlet valve 102 is fluidly connected to a water inlet 100 which is in fluid communication with inner chamber 14 of each exercise device 10. Each exercise device includes a water outlet 104 which is fluidly connected to a water outlet pipe 105. An overflow pipe 103 is fluidly connected to inner chamber 14 proximate to the upper edge 15 of wall 13, and is also fluidly connected to water outlet pipe 105 to assist in preventing water from overflowing tank 12.

A central controller 116 is in electrical communication via cables 123 with the source of heated water 114, water inlet valves 102 and water outlet valves 106. Central controller 116 is preferably a conventional microprocessor which regulates the level of water in each exercise device 10 by controlling the flow of water through each water inlet valve 102 and water outlet valve 106. Controller 115 may also be utilized to control the water temperature by either controlling the amount of heated water delivered to tank 12, or the temperature of the water within water source 114.

An individual controller 120 may be provided for each exercise device 10 to permit a user or other operator to vary the water level and/or temperature for each device without accessing the central controller 116.

The controllers 116 and 120 are in electrical communication via electrical cables 122 so that the temperature and level of the water in each of the exercise devices 10 may be controlled either remotely or at each such exercise device. The positioning of the central controller 116 and water source 114 in the center of the exercise devices 10 reduces the length of inlet pipes 118 and cables 122 and 123 required to operate the system, thereby reducing material costs and heat loss through the pipes 118.

As shown in FIGS. 2–5, each aquatic exercise and therapeutic device 10 comprises a tank 12 having a bottom surface 11 which is preferably rectangular in shape, although other shapes such as oval perform satisfactorily. A vertical wall 13 extends upwardly from the bottom surface 11 to form the inner chamber 14 which includes a rearward end 16 and a forward end 18. Preferably, the vertical wall 13 and bottom surface 11 are formed of coated 12 gage steel. A stiffening rib 108 may be welded or otherwise attached to the exterior of wall 13 to increase the stiffness of wall 13. In the preferred embodiment, stiffening rib 108 is at least ⅜ths of an inch in width and extends from the bottom surface 11 to the upper edge 15 of wall 13 and is also formed of 12 gage steel.

Figure 2:
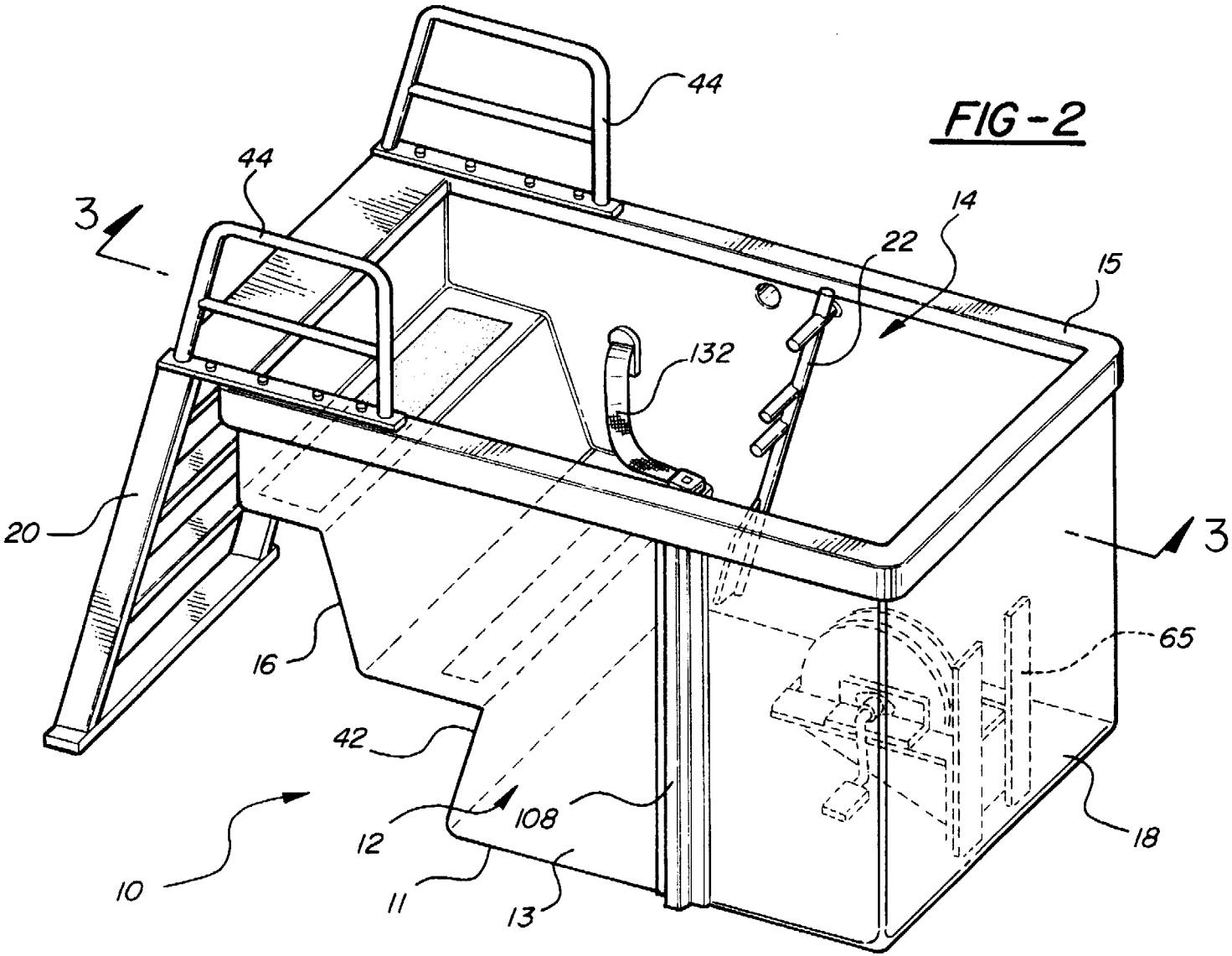
FIG. 2 is a perspective view of the aquatic exercise and therapeutic device of the present invention.
Figure 3:
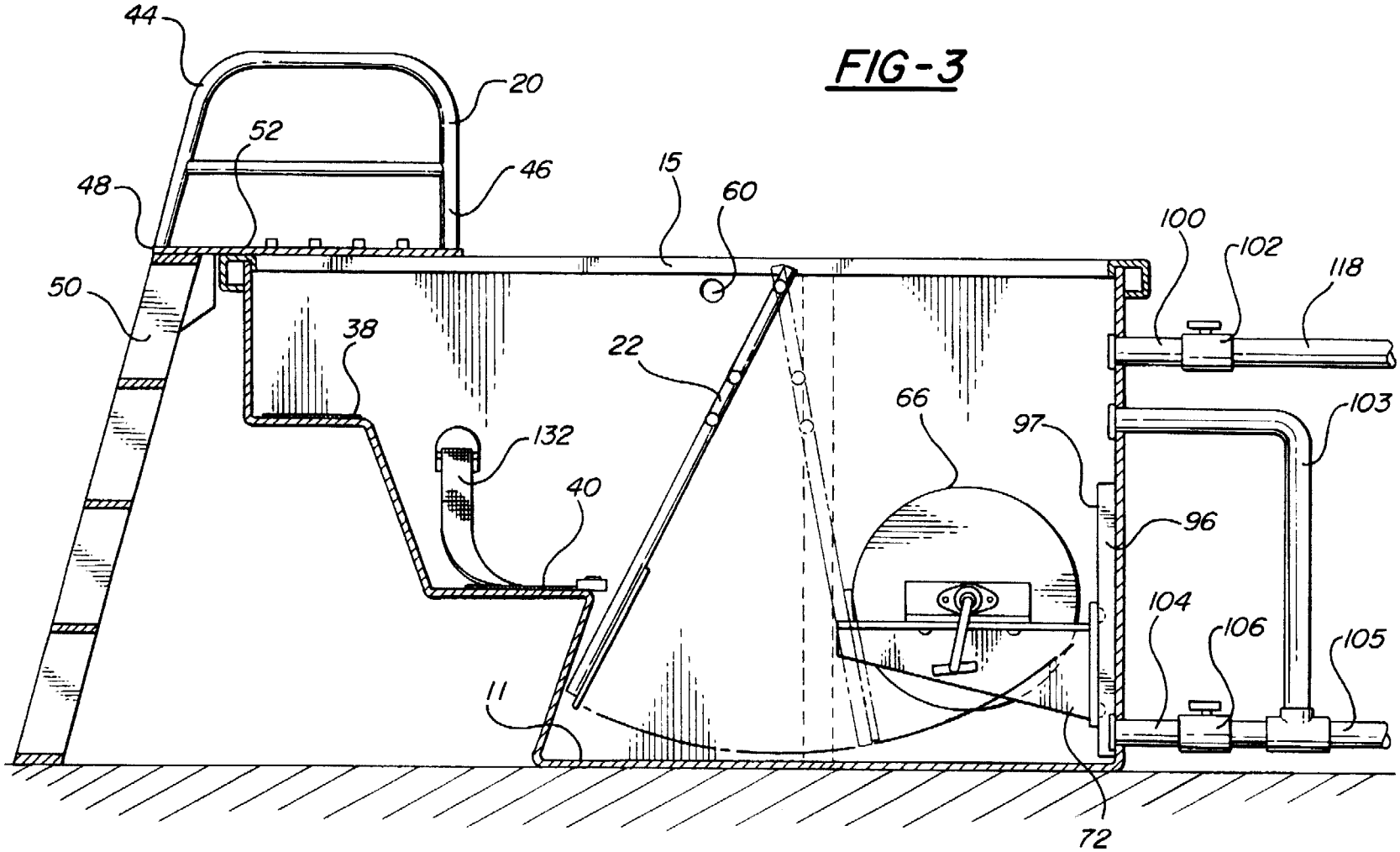
FIG. 3 is a cross-sectional view of the aquatic exercise and therapeutic device depicted in FIG. 2 taken along lines 3—3.

As shown in FIG. 3, wall 13 forms a step 38 and a seat 40 at the rearward end 16 of inner chamber 14. Preferably, at least a portion of seat 40 and step 38 have a non-skid surface to assist the user in safely entering the tank 12. In the embodiment illustrated in FIG. 3, the seat 40 is preferably twelve inches deep by thirty inches wide to enable a user to sit comfortably within the inner chamber 14. As shown in FIG. 2, a safety mechanism such as belt 132 may be attached to the vertical wall at rearward end 16 of inner chamber 14. Preferably, the belt 132 encircles the user's chest and attaches to both the vertical wall 13 at the user's shoulder level and the seat 40 between the user's legs. Belt 132 is configured to prevent the user from slumping forward or sliding off the seat 40 into the water. Preferably, the belt 132 is comprised of a material such as plastic webbing which is resistant to damage from repeated immersion in water.

Figure 13:
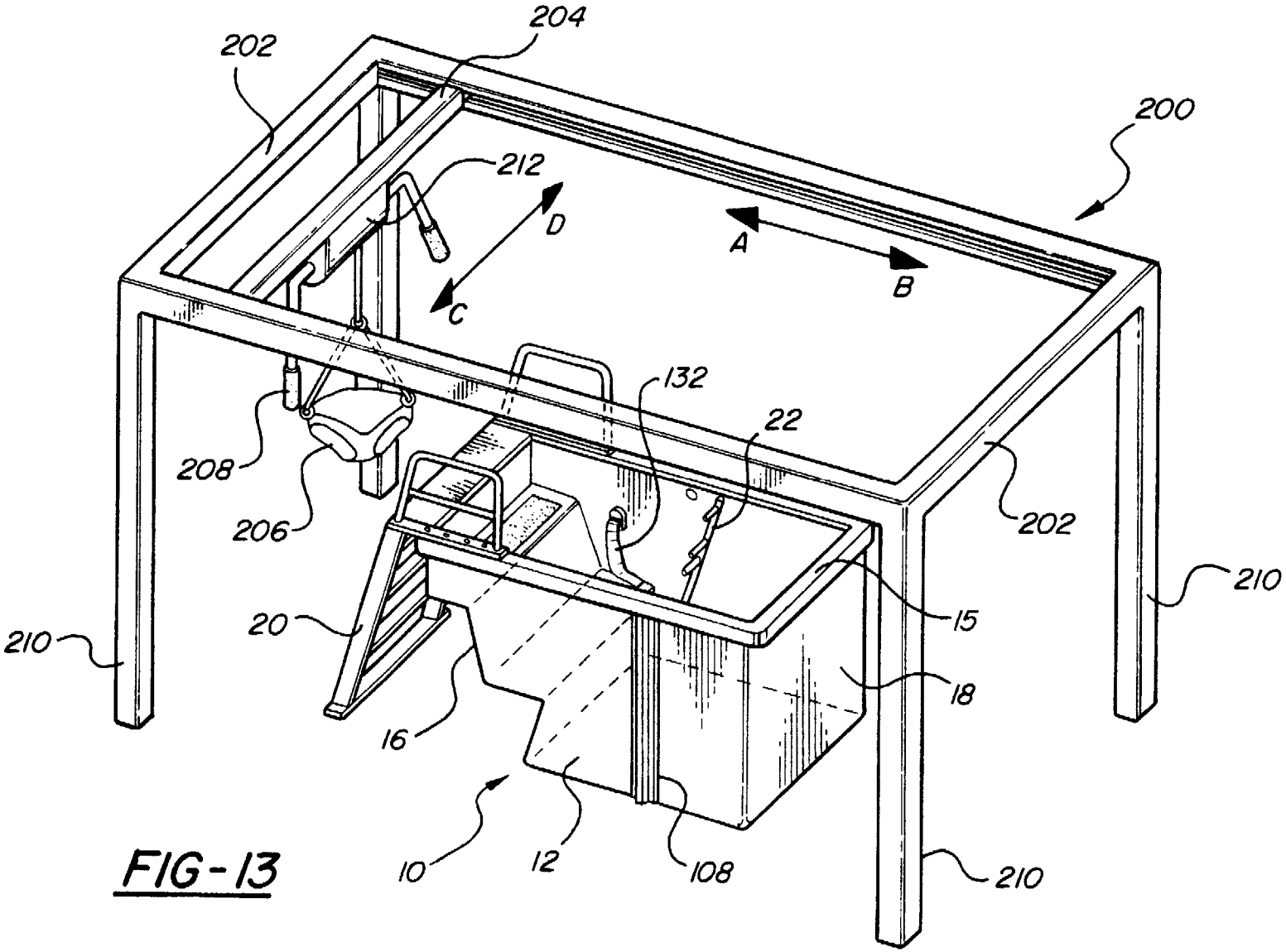
FIG. 13 is a perspective view of the lift.

As shown in FIG. 3, a ladder 20 is attached to the closed vertical wall 13 of the tank 12 enabling a user to easily and safely enter tank 12. Ladder 20 includes a plurality of steps 50, each step preferably having a non-skid surface. The base 51 of ladder 20 is positioned outside of tank 12 and is preferably supported on the same surface which supports tank 12. The ladder 20 also includes a handrail 44 having a forward end 46 and a rearward end 48. Handrail 44 extends upwardly from each side of the uppermost step 50 toward the forward end 18 of tank 12. Attachment bar 52 extends between the forward end 46 of handrail 44 and the rearward end 48 of handrail 44 and is attached to the upper edge 15 of wall 13. In the preferred embodiment, attachment bar 52 is bolted to the upper edge 15 of wall 13, although alternate attachment means such as welding or quick release mechanisms which permit the ladder to be easily and quickly removed from the tank 12 may be used. In the preferred embodiment, handrail 44 extends at least 24 inches above the upper edge 15 of vertical wall 13. The ladder 20 is preferably composed of stainless steel or aluminum. An automated lifting mechanism such as the ChamberLift 2000®, manufactured by Lift Aid, Inc. of Livonia, Mich., may be utilized to place a user with limited mobility into the inner chamber 14 of tank 12. The ChamberLift 2000®, fully described in U.S. Pat. No. 5,511,256 to Capaldi and depicted in FIG. 13, comprises a frame 200 having posts 210 and upper supports 202 positioned around the area in which an individual is to be moved. A moveable sliding beam 204 and motor assembly 212 is mounted to the frame 200. Sliding beam 204 is moveable in the directions of arrows A and B. A sling 206 is mounted to the sliding beam 204 so that the sling 206 may be moved in the vertical direction as well as in the direction of arrows C and D. Thus, an individual supported in sling 206 may be moved by an operator grasping handle 208 and moving the sling 206 and motor assembly 212 to any desired position within frame 200. When used in conjunction with the present invention, a frame is suspended above the exercise device and the area immediately surrounding the exercise device. A user sitting or standing outside exercise device 10 may be placed within the sling and, by moving the sliding beam 204 and motor assembly 212, placed securely on seat 40 of the exercise device 10.

Figure 6:
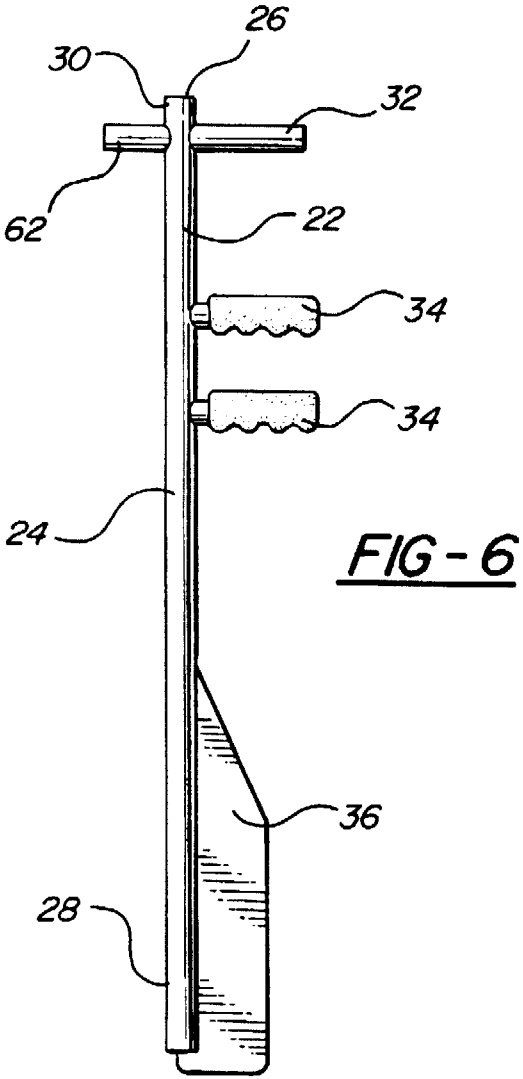
FIG. 6 is a front view of the oar depicted in FIG. 2.
Figure 5:
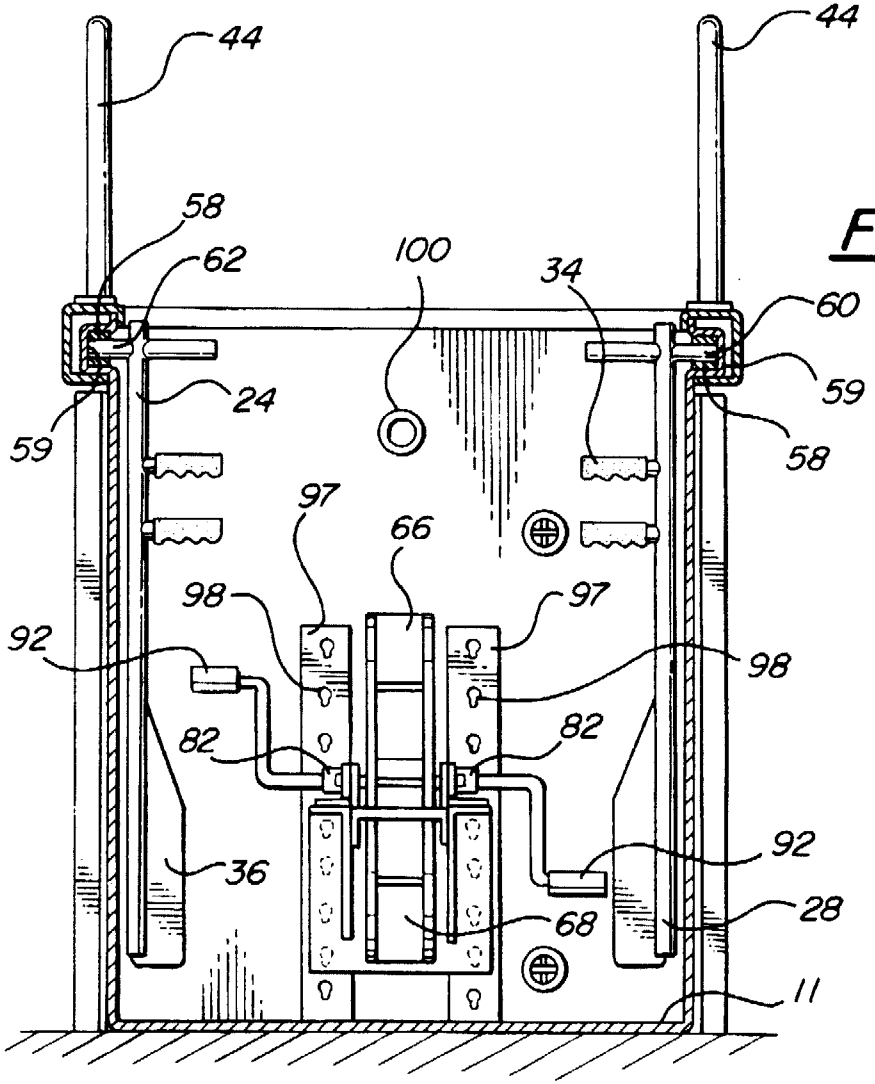
FIG. 5 is a partial cross-sectional view of the aquatic exercise and therapeutic device depicted in FIG. 2 taken along lines 5—5.

A pair of oars 22 are disposed in inner chamber 14. As best shown in FIGS. 5 and 6, each oar 22 comprises an upper end 26, a lower end 28, and an inboard side 24. Each oar 22 is removably and pivotally attached to the wall 13 proximate to the upper end 26 of oar 22 at pivot point 30. As shown in FIG. 5, a pair of bores 60 are formed in the upper edge 15 of wall 13. A sleeve bearing 58, preferably composed of an oil impregnated bronze, is fixedly inserted into each bore 60. Sleeve bearing 58 has a central cavity 59 which is substantially cylindrical in shape. Bearing shaft 62, having a round cross-sectional area and preferably a diameter of at least half an inch, extends from the upper end 26 of oar 22 and is inserted into cavity 59 of sleeve bearing 58. Bearing shaft 62 is freely rotatable within cavity 59 of sleeve bearing 58, permitting the oars 22 to be moved through an arc as shown in FIG. 3. Bores 60 are aligned with each other so that the oars 22 mounted in bores 60 are spaced apart from the user by an equal distance.

At least one pair of bores 60 are provided, but preferably two pairs of bores 60 are formed in the upper edge 15. This permits the user to place the oars in either pair of bores, thus adjusting the distance between the oars 22 and seat 40, comfortably accommodating users of different sizes.

At least one rowing handle 34 extends from the inboard side 24 of each oar 22 below pivot point 30. The user grasps the rowing handle 34 and, by pushing and pulling on handle 34, swings the oar 22 through an arc. As shown in FIG. 2, the vertical wall 13 forms an undercut 42 which permits the oar 22 to be moved through a large arc while keeping the user within arm's reach of the oars. Each rowing handle 34 preferably has a round cross-section, is at least half an inch in diameter, and extends outwardly from oar 22 at least three inches.

A resistance element 36 is attached to the lower end 28 of each oar 22 and extends inwardly from oar 22 into inner chamber 14. The resistance element 26 preferably extends at least twelve inches along oar 22, at least four inches inwardly from oar 22 and is angled at its uppermost end. Each oar is preferably 35 inches in length and comprised of stainless steel.

Oars 22 are easily removed from cavity 59 of sleeve bearing 58 by moving the oar 22 inward, thus permitting oars having different configurations of rowing handles and resistance elements to be interchangeably used within exercise device 10. For example, a short oar which does not extend sufficiently downward to contact seat 40 may be used in the inner chamber which enables a user to swing the oar through a longer arc. Specially configured oars may be designed for users having other particular needs. For example, resistance element 36 may be enlarged or reduced to accommodate a user's strength capability. Handles 34 may be particularly configured for individuals who are unable to securely grasp a round handle. Alternately, handles 34 and resistance element 36 may be removably attached to the oars 22 so that they may be interchanged with handles and resistance elements having different configurations.

An entry assist handle 32 extends from the inboard side 24 of oar 22. The entry handle 32 is attached to the oar 22 opposite the bearing shaft 62 so that force applied by the user to entry assist handle 32 while entering or exiting exercise device 10 does not cause movement of oar 22 or entry handle 32 with respect to the user, thus providing a secure handhold for the user. In the preferred embodiment, handle 32 and bearing shaft 62 are formed as a single rod, passing through oar 22 and having a diameter of at least half an inch.

A cycling assembly 65 comprising a turbine 66 is shown in FIGS. 3–5 and 7–10. As shown in FIG. 7, turbine 66 comprises two spaced apart circular plates 94 having an outer edge 95, plates 94 being substantially parallel to each other. A bore 70 is positioned at the center of circular plates 94 and extends through both circular plates. Disposed between circular plates 94 are a plurality of turbine blades 68 which extend from bore 78 to the outer edge 95 of the circular plates 94. Turbine blades 68 provide resistance to circular motion of turbine 66 as it is rotated through water. In the preferred embodiment, eight turbine blades 68 are utilized. Preferably, plates 94 are 16 inches in diameter.

Turbine 66 is fixedly attached to a shaft 88 having two ends 89. An offset portion 90 is positioned proximate to each end 89, the offset portion 90 extending substantially perpendicular to shaft 88. Two pedals 92 are provided, each pedal 92 rotatably mounted to one of the ends 89 so that, when the user pushes on pedals 92 with a cycling motion, the shaft 88 turns turbine 66 about its center. The turbine blades 68 provide resistance while creating turbulence in the water, providing a therapeutic massage to the user during exercise. Preferably, the turbine 66, blades 68 and shaft 88 are composed of a metal such as stainless steel. Pedal 92 may be composed of plastic or metal such as stainless steel, and may include straps to secure the user's foot to the pedal.

The turbine 66, shaft 88 and pedals 92 are mounted to a cycling assembly mounting bracket 72 via a pair of turbine bearing plates 82, shown in FIGS. 9–10. The turbine bearing plate 82 comprises a backplate 83. Attached to one side of backplate 83 is a flange bearing 54, an aperture 84 extends therethrough the flange bearing 54 and back plate 83. Positioned beneath bearing 54 is a flange 85 which extends perpendicularly to backplate 83 and extends outwardly from backplate 83 in the same direction as bearing flange 54. Thus, turbine bearing plate 82 has a planar side 56 which is substantially flat. At least two bosses 86 are mounted upon and extend downwardly from flange 85. As shown in FIG. 10, the planar surface 56 of each turbine bearing plate is positioned proximate to one of the protective plates 94 of turbine 66 so that apertures 84 are aligned with the turbine bore 70. Shaft 88 passes through the apertures 84 and turbine bore 70, with one offset portion 90 and one pedal 92 positioned on each side of turbine 66. The turbine bearing plates 82 are preferably formed of a metal such as stainless steel or the like.

The cycling assembly mounting bracket 72, shown in FIGS. 11 and 12, comprise a plate 74 having a forward side 75 and a rearward side 73. Extending from the forward side 75 are two substantially parallel, spaced apart arms 76 having ends 77. A pair of bosses 79 extend outwardly from the rearward side 73 of plate 74. A brace 80 is positioned between the arms 76 proximate to their ends 77 to ensure that the arms 76 remain parallel to each other. Brace 80, plate 74 and arms 76 form a slot 71 into which the turbine 66 is placed. In the preferred embodiment, the cycling assembly mounting bracket is comprised of metal such as stainless steel or the like, and arms 76 are at least 18 inches in length and one and one-quarter inches wide.

A plurality of keyhole slots 78 are formed in the arms 76. The keyhole slots 78 are positioned on the arms 76 so that the keyhole slots on one arm are aligned with the keyhole slots on the other arm. The bosses 86 extending downwardly from turbine bearing plates 82 are configured to mate with the keyhole slots 78. When the turbine bearing plates 82 are positioned on the arms 76 so that the bosses 86 mate with aligned keyhole slots 78, the apertures 84 of each turbine bearing plate are aligned with each other so that the shaft 88 may pass through the apertures 84.

Figure 4:
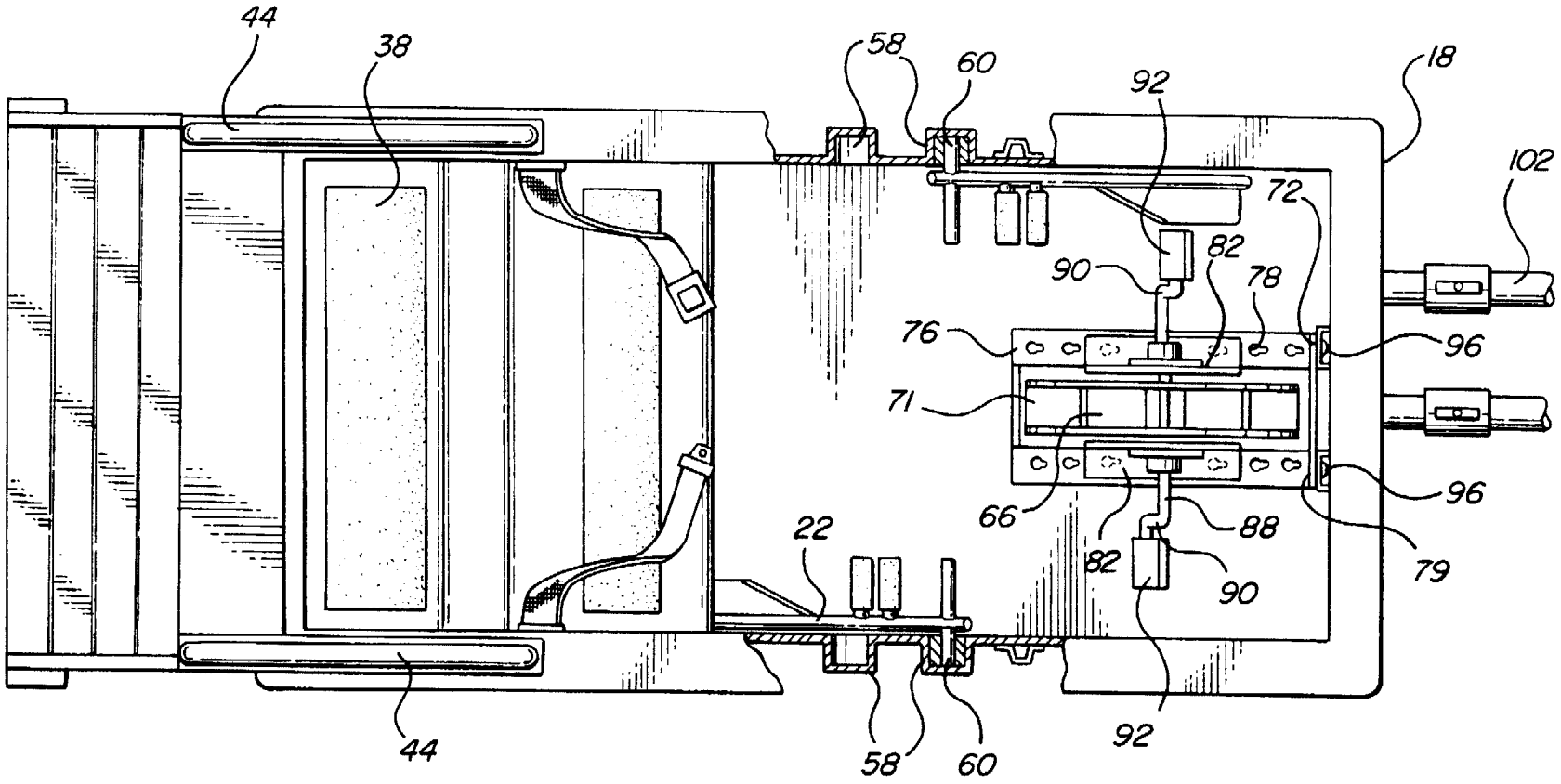
FIG. 4 is a top view of the aquatic exercise and therapeutic device depicted in FIG. 2.

As shown in FIG. 4, the turbine 66 is disposed between arms 76, and the offset portions 90 of the shaft 88 are disposed outwardly of the arms 76 to permit unimpeded rotation of the pedals 92 when the turbine 66 is mounted to the cycling assembly mounting bracket 72.

The mounting bracket 72 is adjustably attached via bosses 79 to a frame 96 affixed to the forward end 18 of wall 13. As shown in FIGS. 3 and 4, frame 96 comprises two elongated channels 97 into which keyhole slots 98 are formed. The keyhole slots 98 are positioned on the channels 97 so that the keyhole slots on one channel are aligned with the keyhole slots on the other channel. The bosses 79 of the mounting bracket 72 are mated with keyhole slots 98 in channels 97. Thus, the mounting bracket 72 is attached to frame 96 on wall 13 so that mounting bracket 72 extends substantially parallel to the bottom 11 of tank 12 and is adjustable in the vertical direction relative to bottom 11.

The user may adjust the position of the pedals 92 closer to or farther away from seat 40 in the horizontal direction by mating bosses 86 of turbine bearing plates 82 with aligned keyhole slots 78 on mounting bracket 72 which are closer to or farther away from seat 40. The user may adjust the position of the pedals 92 vertically away from or closer to bottom 11 by mating bosses 79 on mounting bracket 72 with different aligned keyhole slots 98 on frame 96. Alternately, pedals 92 may be interchangeable with handgrips 34 shown in FIG. 5. A user may move the turbine 66 to a position sufficiently close to the user so that the user may utilize their upper body to move the turbine in a cycling motion by gripping and rotating the handgrips.

As shown in FIG. 1, sensors 124 may be positioned in the inner chamber 14 of each exercise device to detect the water temperature and level. Appropriate sensors to detect water temperature and level are commonly available. Sensors 124 are in electrical communication with the controllers 116 and 120.

Preferably, moveable partitions are provided between the exercise devices and central controller so that users may exercise in privacy. As shown in FIG. 1, a plurality of curtain tracks 128 from which opaque curtains may extend are disposed between the exercise devices 10, isolating the exercise devices from each other. A central curtain track 130 permits the central heated water source 114 and central controller 116 to be surrounded by an opaque curtain so that an operator positioned at the central controller 116 cannot view a user in an exercise device. An outer curtain track 126 may also be provided so that a curtain may be placed around the exercise devices. Alternately, moveable or permanent walls may be positioned about the exercise devices to provide privacy for the users.

Additionally, each exercise device may include an agitator to provide increased turbulence in the water, thus providing enhanced therapeutic massage.

Having described the various embodiments of the present invention with reference to the accompanying figures, it will be appreciated that various changes and modifications can be made without departing from the scope or spirit of the invention.

I claim:

1. An aquatic exercise and therapeutic device comprising:

a tank having a bottom surface, a closed vertical wall having an upper edge, the wall extending upwardly from the bottom surface forming an inner chamber having a forward end and a rearward end, the wall forming a seat suitable for positioning a user within the inner chamber;

a safety belt attached to the wall proximate to the seat;

a vertical stiffening member mounted to the vertical wall;

a source of water;

a water inlet in communication with the source of water and the inner chamber of the tank, a water outlet in communication with the inner chamber of the tank, a ladder having a handrail, the ladder attached to the closed vertical wall of the tank enabling a user to enter the tank;

a pair of oars disposed in the inner chamber, each oar having an upper end, a lower end, an inboard side, means for pivotally attaching the upper end of each oar to the upper edge of the wall of the tank, at least one rowing handle positioned below the means for pivotally attaching the oar to the vertical wall, the handles extending from the inboard side of the oar, and a resistance element extending from the inboard side of the oar, the resistance element positioned proximate to the lower end of the oar, an entry assist handle attached to the inboard side of each oar aligned with the means for pivotally attaching the oar to the tank;

a cycling assembly comprising a turbine, a shaft having two ends and two offset portions, each offset portion positioned proximate to each end and extending substantially perpendicular to the shaft, the shaft mounted to the turbine to provide circular motion to the turbine, and two pedals, each pedal mounted to one of the ends of the shaft enabling a user to rotate the shaft and turbine by pushing on the pedals;

a frame attached to the vertical wall proximate to the forward end of the inner chamber;

a cycling assembly mounting bracket extending substantially parallel to the bottom surface, the mounting bracket being adjustably mounted to the frame so that the position of the mounting bracket relative to the bottom surface may be adjusted, the cycling assembly being adjustably and rotatably mounted to the mounting bracket so that the pedals may be adjusted relative to the user positioned within the inner chamber of the tank.

2. An aquatic exercise and therapeutic device comprising:

a tank having a bottom surface, a closed vertical wall extending upwardly from the bottom surface forming an inner chamber having a forward end and a rearward end, the wall forming a seat suitable for positioning a user within the inner chamber;

a source of water;

a water inlet in communication with the source of water and the inner chamber of the tank;

a water outlet in communication with the inner chamber of the tank;

a lift for placing a user within the tank;

a pair of oars disposed in the inner chamber, each oar having an upper end, a lower end, an inboard side, means for pivotally attaching the upper end of each oar to the vertical wall of the tank, at least one rowing handle positioned below the means for pivotally attaching the oar to the wall, the handles extending from the inboard side of the oar, and a resistance element extending from the inboard side of the oar, the resistance element positioned proximate to the lower end of the oar;

a cycling assembly comprising a turbine, a shaft having two ends and two offset portions, each offset portion positioned proximate to each end and extending substantially perpendicular to the shaft, the shaft mounted to the turbine to provide circular motion to the turbine, and two pedals, each pedal removably mounted to one of the ends of the shaft enabling a user to rotate the shaft and turbine by pushing on the pedals; and means for adjustably and rotatably mounting the cycling assembly to the forward end of the inner chamber so that the user may rotate the cycling assembly and adjust the position of the pedals in the vertical and horizontal directions.

3. The device of claim 2, further including a safety belt attached to the wall proximate to the seat.

4. An aquatic exercise and therapeutic device comprising:

a tank having a bottom surface, a closed vertical wall extending upwardly from the bottom surface forming an inner chamber having a forward end and a rearward end, the wall forming a seat suitable for positioning a user within the inner chamber;

a source of water;

means for introducing water into the inner chamber of the tank;

means for draining water from the inner chamber of the tank;

a pair of oars disposed in the inner chamber, each oar having an upper end, a lower end, an inboard side, means for pivotally attaching the upper end of each oar to the wall of the tank, at least one rowing handle positioned below the means for pivotally attaching the oar to the vertical wall, the handles extending from the inboard side of the oar, and a resistance element extending from the inboard side of the oar, the resistance element positioned proximate to the lower end of the oar;

a cycling assembly comprising a turbine, a shaft having two ends and two offset portions, each offset portion positioned proximate to each end and extending substantially perpendicular to the shaft, the shaft mounted to the turbine to provide circular motion to the turbine, and two pedals, each pedal mounted to one of the ends of the shaft enabling a user to rotate the shaft and turbine by pushing on the pedals; and means for adjustably and rotatably mounting the cycling assembly to the forward end of the inner chamber so that the user may rotate the cycling assembly and adjust the position of the pedals in the vertical and horizontal directions.

5. The device of claim 4 further including an entry assist handle attached to the inboard side of each oar aligned with the means for pivotally attaching the oar to the tank.

6. An aquatic exercise and therapeutic system comprising a plurality of aquatic exercise devices, each device comprising a tank having a bottom surface, a closed vertical wall extending upwardly from the bottom surface forming an inner chamber having a forward end and a rearward end, the wall forming a seat suitable for positioning a user within the inner chamber, a source of water, means for introducing water into the inner chamber of the tank, means for draining water from the inner chamber of the tank, a pair of oars disposed in the inner chamber, each oar having an upper end, a lower end, an inboard side, means for pivotally attaching the upper end of each oar to the wall of the tank, at least one rowing handle positioned below the means for pivotally attaching the oar to the vertical wall, the handles extending from the inboard side of the oar, and a resistance element extending from the inboard side of the oar, the resistance element positioned proximate to the lower end of the oar, a cycling assembly comprising a turbine, a shaft having two ends and two offset portions, each offset portion positioned proximate to each end and extending substantially perpendicular to the shaft, the shaft mounted to the turbine to provide circular motion to the turbine, and two pedals, each pedal mounted to one of the ends of the shaft enabling a user to rotate the shaft and turbine by pushing on the pedals, and means for adjustably and rotatably mounting the cycling assembly to the forward end of the inner chamber so that the user may rotate the cycling assembly and adjust the position of the pedals in the vertical and horizontal directions;

means for heating the water contained within the source of water; and controlling means for controlling the amount and temperature of water within each device; the controlling means in communication with the means for heating the water and the source of water.

7. The system of claim 6 wherein the controlling means includes a central controller.

8. The system of claim 6 wherein the controlling means further includes a plurality of device controllers, one device controller mounted to each exercise device.

9. The system of claim 6 wherein the exercise devices are arranged about a central point so that the longitudinal axis of each device extends radially outwardly from the central point.

10. The system of claim 6 further including sensing means for detecting the amount and temperature of water within each exercise device, the sensing means in communication with the controller.

11. An aquatic exercise and therapeutic system comprising:

a plurality of aquatic exercise devices, each device comprising a tank having a bottom surface, a closed vertical wall having an upper edge, the wall extending upwardly from the bottom surface forming an inner chamber having a forward end and a rearward end, the wall forming a seat suitable for positioning a user within the inner chamber, a safety belt attached to the wall proximate to the seat, a vertical stiffening member mounted to the vertical wall, a source of water, a water inlet in communication with the source of water and the inner chamber of the tank, a water outlet in communication with the inner chamber of the tank, a ladder having a handrail, the ladder attached to the closed vertical wall of the tank enabling a user to enter the tank, a pair of oars disposed in the inner chamber, each oar having an upper end, a lower end, an inboard side, means for pivotally attaching the upper end of each oar to the upper edge of the wall of the tank, at least one rowing handle positioned below the means for pivotally attaching the oar to the vertical wall, the handles extending from the inboard side of the oar, and a resistance element extending from the inboard side of the oar, the resistance element positioned proximate to the lower end of the oar, an entry assist handle attached to the inboard side of each oar aligned with the means for pivotally attaching the oar to the tank, a cycling assembly comprising a turbine, a shaft having two ends and two offset portions, each offset portion positioned proximate to each end and extending substantially perpendicular to the shaft, the shaft mounted to the turbine to provide circular motion to the turbine, and two pedals, each pedal mounted to one of the ends of the shaft enabling a user to rotate the shaft and turbine by pushing on the pedals, a frame attached to the vertical wall proximate to the forward end of the inner chamber, a cycling assembly mounting bracket extending substantially parallel to the bottom surface, the mounting bracket being adjustably mounted to the frame so that the position of the mounting bracket relative to the bottom surface may be adjusted, the cycling assembly being adjustably and rotatably mounted to the mounting bracket so that the pedals may be adjusted relative to the user positioned within the inner chamber of the tank;

means for heating the water contained within the source of water;

sensing means for detecting the amount and temperature of water within each exercise device; and controlling means for controlling the amount and temperature within each device, the controlling means in communication with each sensing means, the means for heating the water and the source of water.

* * * * *